United States Patent [19]

McCullough et al.

[11] Patent Number: 4,911,621

[45] Date of Patent: Mar. 27, 1990

[54] SCROLL FLUID DEVICE USING FLEXIBLE TOOTHED RING SYNCHRONIZER

[75] Inventors: John E. McCullough, Carlisle, Mass.; Niels O. Young, Eagle, Id.

[73] Assignee: Arthur D. Little, Inc., Cambridge, Mass.

[21] Appl. No.: 208,915

[22] Filed: Jun. 20, 1988

[51] Int. Cl.[4] ..... F01C 1/04; F01C 17/00; F16D 3/04; F16D 3/54

[52] U.S. Cl. ..... 418/55; 418/188; 464/88; 464/102

[58] Field of Search ..... 418/55 R, 55 B, 188; 464/88, 92, 102, 154

[56] References Cited

U.S. PATENT DOCUMENTS

| | | | |
|---|---|---|---|
| 2,537,847 | 1/1951 | Neher | 464/88 |
| 2,952,143 | 9/1960 | Case | 464/88 |
| 3,360,962 | 1/1968 | Firth | 464/88 |
| 4,178,143 | 12/1979 | Thelen et al. | 418/55 R |
| 4,534,718 | 8/1985 | Blain | 418/55 R |
| 4,610,610 | 9/1986 | Blain | 418/55 D |
| 4,610,611 | 9/1986 | Blain | 418/55 D |
| 4,613,291 | 9/1986 | Sidransky | 418/55 A |

FOREIGN PATENT DOCUMENTS

| | | | |
|---|---|---|---|
| 61-8488 | 1/1986 | Japan | 418/55 B |
| 696198 | 11/1979 | U.S.S.R. | 464/154 |

*Primary Examiner*—John J. Vrablik
*Attorney, Agent, or Firm*—Bacon & Thomas

[57] ABSTRACT

A scroll fluid device is provided with a toothed ring synchronizer coupled to sprocket teeth provided of each scroll wrap back plate. The coupling between the teeth does not restrict relative axial motion between the scroll wraps and evenly distributes torque loads resulting from forces tending to rotate one wrap relative to the other between the back plates. The ring synchronizer may include internal or external teeth cooperating with adjoining sprocket teeth provided on the scroll back plates.

14 Claims, 3 Drawing Sheets

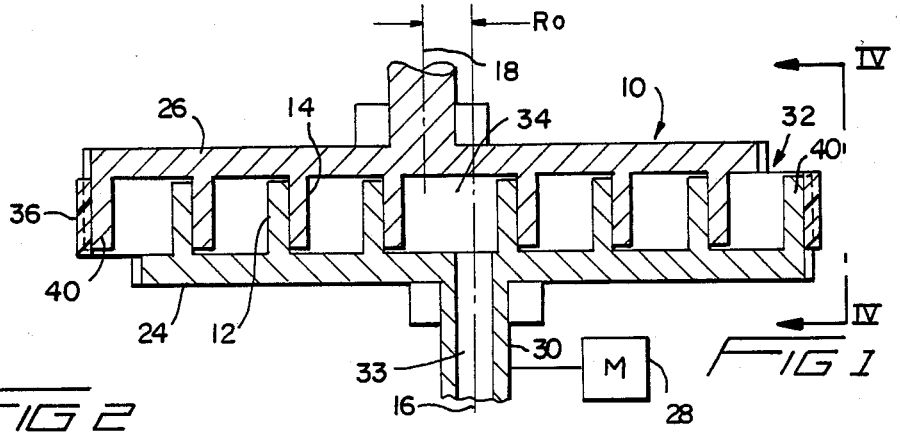
FIG 1
FIG 2
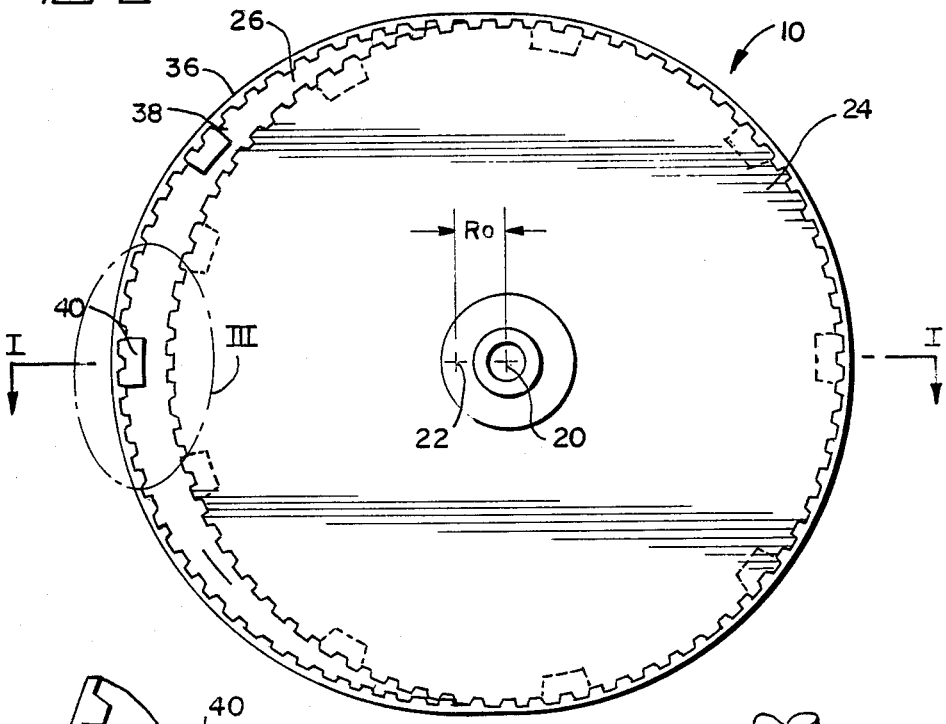
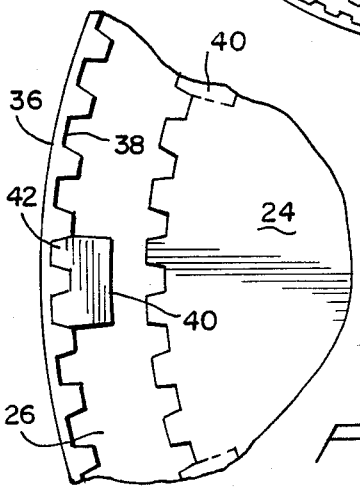
FIG 3
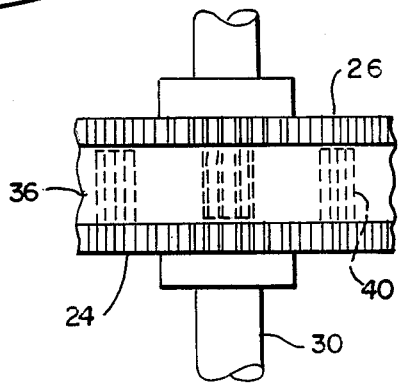
FIG 4

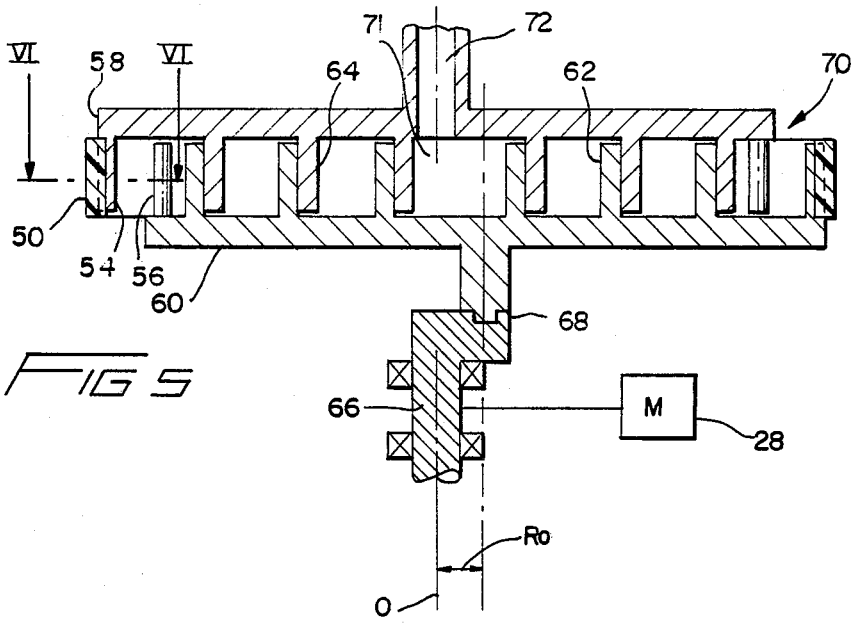
FIG 5
FIG 6
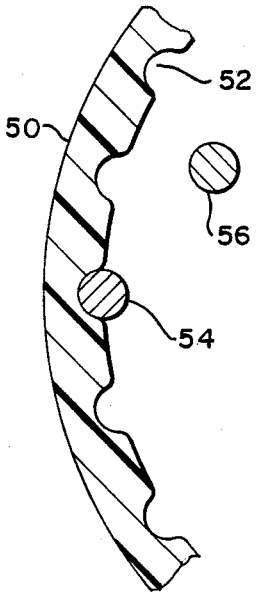
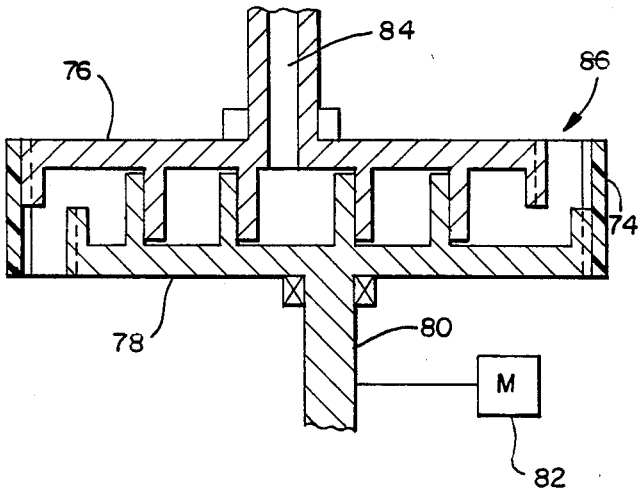
FIG 7

SCROLL FLUID DEVICE USING FLEXIBLE TOOTHED RING SYNCHRONIZER

BACKGROUND OF THE INVENTION

1. Field of the Invention

This invention is in the field of scroll fluid devices wherein meshed involute scroll wraps move in orbital fashion relative to each other to effect energy transfer by positive fluid displacement in chambers generated between the scroll wraps during operation of the device.

2. Description of Prior Art

The generic term "scroll fluid device" is applied to the well-known arrangement of meshed, involute spiral wraps that are moved along curvilinear translation paths in orbiting fashion relative to each other to produce one or more fluid transporting or working chambers that move radially between entrance and exit zones of the device. The scroll devices may function as pumps, compressors, expanders, or motors, depending upon their configuration, the drive system, and the nature of energy transfer between the scroll wraps and the fluid moving through the device.

Scroll devices, including their principle of operation, are fully described by way of example in the following U.S. Pat. Nos. 3,874,827 to Niels O. Young; 3,560,119 to W. Busch et al.; and 4,141,677 to Weaver et al. The descriptions contained in the aforementioned patents, to the extent that they generally describe the theory of operation and typical structural arrrangements of scroll fluid devices is herein incorporated by reference.

In scroll fluid devices, it is usually imperative that the scroll wraps be maintained in an established phase relationship in respect of their angular orientation relative to each other. Essentially, once the wraps are meshed in an established or desired position in which the involute wraps are disposed in a certain relative angular position relative to each other, this position must be maintained during the operation of the scroll device to maintain sealing contact between wrap flanks (sidewalls) and to maintain the design configuration of the fluid chamber that effects positive displacement of fluid moving through the scroll device (if a pump) or that constitutes the working chamber of the device (if a motor). While minor excursions from the design set point may be tolerated in some designs, generally, the relative angular position of the scroll wraps must be maintained during the operation of typical scroll fluid devices.

In the prior art, the relative angular orientation of the scroll wraps is maintained typically by Oldham couplings that maintain the meshed scroll wraps in torisonally coupled relationship that permits relative orbital movement while restricting relative rotation between the wraps. The aforementioned patents described typical Oldham couplings.

A problem encountered in prior art devices is that typical Oldham couplings are often imprecise, require lubrication under higher loads and speeds of operation, and they are subject to rotational imbalances when the scroll wraps are co-rotated together as a spinning unit.

While some approaches have been taken in the prior art to eliminate such disadvantages, typically the solution leads to other disadvantages, including complexity, structurally weaker designs, or restrictions against certain degrees of movement of the scroll wraps that might be desired or necessary for optimized performance of the device.

BRIEF SUMMARY OF THE INVENTION

The present invention contemplates using a flexible synchronizer in the form of a ring, belt or hoop element coupled by teeth or the equivalent to the scroll wrap back plates, with the latter being provided with sprocket teeth or the equivalent coupled to the synchronizer teeth.

The coupled synchronizer and sprocket teeth are periodically engaged as one scroll orbits relative to the other scroll so that teeth wear is distributed fully around the synchronizer ring. Moreover, numerous teeth can be coupled at any one time to distribute the torque load between scroll wraps evenly along the length of the synchronizer ring.

Essentially, the scroll wraps are provided with sprocket teeth spaced symmetrically about the axis of the base circle of each involute wrap or scroll. Generally, the sprocket teeth will be located in a circle around the periphery of a circular back plate for each scroll wrap. The number of teeth, their pitch, size and shape all are selected in accordance with those design parameters that will optimize the coupling between the synchronizer and the scroll wraps, as well as effect the smooth transfer of torque loads between the wraps.

The synchronizer ring, configured as a belt or flexible ring, is provided with ring teeth that engage and cooperate in coupling relationship with sprocket teeth associated with the back plates of the scroll wraps. Depending on design objectives, the synchronizer may be located inside of the sprocket teeth and include external ring teeth, or may be located on the exterior of the sprocket teeth with internal ring teeth engaging the sprocket teeth.

Forces tending to cause rotation of one wrap relative to the other are reacted through the ring teeth and sprocket teeth so as to be transferred between the wraps via the synchronizer to thereby prevent relative rotation between the wraps Various other details of the invention and specific embodiments of same will be evident from reading the ensuing detailed description and viewing the appended illustrations.

DESCRIPTION OF THE DRAWINGS

FIG. 1 is an elevational cross-section schematic view of a co-rotating scroll fluid device in cross-section incorporating the ring synchronizer according to the invention, with the synchronizer having internal teeth coupling elements;

FIG. 2 is a bottom plan view of FIG. 1;

FIG. 3 is a detailed view of an area 3 of FIG. 2;

FIG. 4 is an end view of FIG. 1 taken along line 4—4;

FIG. 5 is similar to FIG. 1 and shows the synchronizer ring applied to a single orbiting scroll device with an alternate configuration of teeth coupling elements;

FIG. 6 is a detailed view taken along line 6—6 of FIG. 5;

FIG. 7 is similar to FIG. 1 showing an alternate synchronizer arrangement used with a single orbiting scroll device;

DETAILED DESCRIPTION OF PREFERRED EMBODIMENT

Figure 9:
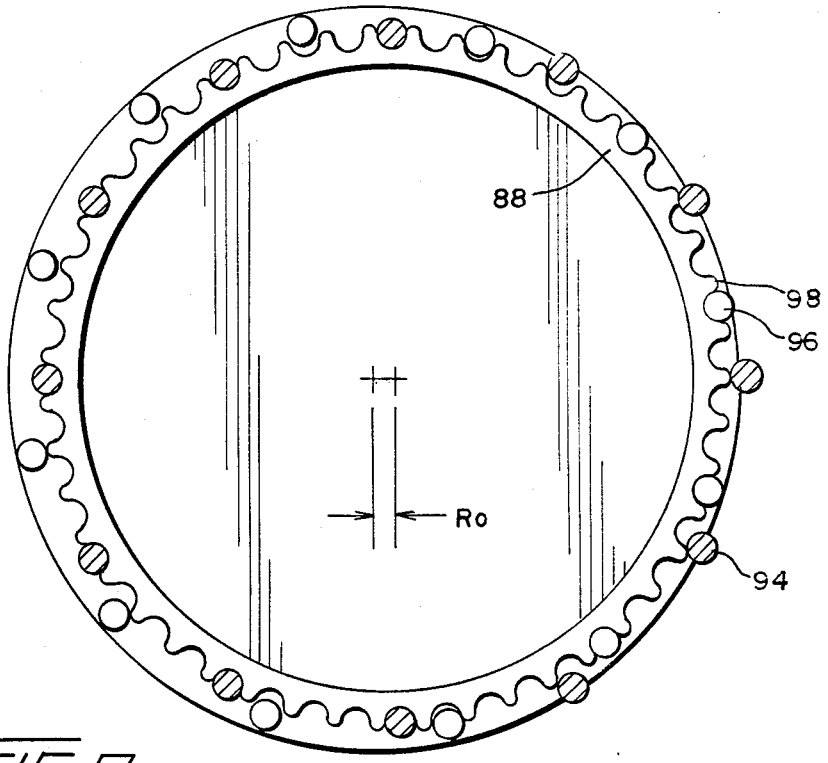
FIG. 9 is a view taken along line 9—9 of FIG. 8.

With reference to the drawings, and in particular with reference to FIGS. 1, 2, 3 and 4, a scroll fluid device 10 is illustrated schematically and includes co-rotating scroll wraps 12, 14 mounted for rotation about axes of rotation 16, 18, the axes intersecting the base centers 20, 22 of involute wraps 12, 14, in accordance with known principles as described in the aforementioned patent literature. The scroll wraps 12, 14 are supported by back plates 24, 26 which in turn are driven in rotation about axes, 16, 18, by motor 28 or other appropriate driving means. This is a typical arrangement for a co-rotating scroll compressor, with energy input being supplied by a motor 28. Typically, upon rotation of motor 28 being imparted to an input drive shaft 30, fluid admitted at intake area 32 is radially transported by at least a single pocket or chamber defined by the cooperating, meshed involute wraps 12, 14 and discharged through outlet 33 which is in communication with the central area 34 of the meshed, axially extending wraps 12, 14. Since the wraps are supported for co-rotation about spaced, parallel axes 16, 18, the wraps will also move relative to each other (i.e. orbit) along curvilinear translation paths about an orbit center, all as described in the various patent literature previously mentioned.

The illustration of FIG. 1 is exemplary only for a typical scroll compressor, and it will be understood that various driving arrangements could be utilized so that the scroll device operates as a pump, compressor, expander or motor, depending upon the effect to be obtained by the transfer of energy between the scroll wraps and the fluid moving through the device. For example, the motor 28 could be eliminated if pressurized fluid were admitted through the outlet duct 33 in a reverse direction and exhausted through the area 32, whereby the system would operate as a motor by the transfer of energy from the compressed fluid to the scroll wraps.

The present invention is concerned with a synchronizer for maintaining the scroll wraps 12, 14 in a predetermined geometric relationship whereby, once an angular relationship is established between the wraps, it does not substantially change while the system is operating. In the prior art, Oldham couplings are typically used for this function although other synchronizer arrangements have been utilized.

In accordance with the present invention, sychronization between the wraps 12, 14 is maintained by a flexible synchronizer ring 36 that is coupled, in accordance with the preferred embodiment, with the wrap supports 24, 26 by coupling elements that are broadly termed "teeth" for reasons that will become more evident in the ensuing discussion. In its simplest form, the synchronizer ring 36 is flexible, substantially inextensible, and extends in a belt or hoop-like fashion so as to span cooperating coupling "teeth" provided around the peripheries of the back plates 24, 26 (see FIGS. 2–3).

As best illustrated in FIG. 3, ring 36 is provided with teeth-like indentations 38 around its inner periphery, the indentations 38 cooperating with similar "teeth" 40 that axially project from the back plates 24, 26 in interdigited relationship in accordance with this embodiment. The teeth 40 include male protrusions or ridges 42 that directly cooperate with the tooth indentations 38 of ring 36 so as to form a direct driving relationship between the back plates 24, 26 and ring 36. Since the teeth 40 will typically drive the ring 36, for convenience the teeth 40 are termed "sprocket" teeth so that the driving relationship can be readily envisioned from the descriptive term "sprocket". However, it should be understood that the invention is not limited to a situation where the sprocket teeth perform the driving function between the wraps, since energy input to the scroll device could be applied through the ring 36 by a suitable power or gear arrangement (not illustrated).

The synchronizer ring teeth elements 38 cooperate with the sprocket teeth 40 to maintain the back plates 24, 26 in alignment with each other in a rotational sense. Any forces tending to rotationally displace one back plate with respect to the other is reacted through the sprocket and ring teeth elements from one back plate to the other to prevent relative rotation between the back plates. The flexibility of the synchronizer ring 36 permits it to be bent out of round sufficiently to accommodate the relative orbital movement between the back plates, while the inextensible characteristic of the synchronizer ring prevents displacement of the sprocket teeth on one back plate in a rotational sense with respect to the sprocket teeth on the other back plate. That is, as seen in FIG. 2, the teeth of the sychronizer ring always will be coupled to at least one of the sprocket teeth 40 of both backplates 24, 26, but will only be coupled to one set of sprocket teeth of one plate 24 or 26 at a pair of positions located on diametrically opposite sides of the orbit radius of the scroll wraps, these positions lying on a line including wrap (base) centers 20, 22.

The arrangement of ring and sprocket teeth is selected so that there are more ring teeth than sprocket teeth to account for the lateral displacement of axes 16 and 18.

Generally, it is preferred to avoid overturning moments on the ring synchronizer 36 by locating the synchronizer in the same plane as the wraps 12, 14, with the sprocket teeth 40 interdigited or overlapping in an axial sense. However, and this will be described later, the sprocket teeth 40 conceivably could be axially spaced apart without changing the principle of operation of the invention. The number of ring teeth elements 38 is greater than the number of sprocket teeth means 42. However, it will be understood that any conceivable arrangement of a coupling system that would function in the same manner as the illustrated teeth elements would function to obtain the objective of the invention. Essentially, the critical requirement is that the ring synchronizer 36 must not interfere with the axial influences between the back plates 24, 26 so as not to disturb the axial setting or freedom of movement of the wraps 12, 14. Thus, it is desirable to have axially extending teeth such as illustrated, whereby the ring synchronizer 36 is free to float somewhat axially without limiting axial travel between the scroll wraps. Of course, any suitable motion limiter can be provided to prevent the synchronizer ring 36 from traveling beyond the teeth 40 or the back plates 24, 26. A suitable snap ring (not illustrated) or pin (not illustrated) or rim (not illustrated) could be provided in each back plate to limit the degree of axial movement of the synchronizer ring 36. However, during operation, the ring 36 does not interfere with axial displacement or positions of the wraps 12, 14. Moreover, it will be noted that the synchronizer ring arrangement does not require reaction of torque loads into a housing or other fixed structure to prevent relative rotation between the wraps 12, 14. Rather, all influences tending to rotate one wrap relative to the other are reacted between the back plates through the synchronizer so as to maintain the same relative angular orientation between the wraps in a simple yet precise manner.

It will also be observed that centrifugal forces are inherently balanced using a synchronizer such as the synchronizer ring 36. Unlike complex Oldham couplings constructed in accordance with the prior art, the system is inherently balanced in rotation due to its symmetrical construction. In addition, lubrication is essentially unnecessary, since synchronizer and sprocket ring teeth materials can be selected to be self-lubricating. Since there is little relative movement between the sprocket and ring teeth, lubrication generally is not considered to be problematic.

In accordance with an alternate embodiment of the invention, as seen in FIGS. 5 and 6, a synchronizer ring 50 having cylindrical teeth elements 52 is arranged to cooperate with cylindrical, pin-like teeth 54, 56 which respectively axially project towards each other from back plates 58, 60 in a scroll device including an orbiting wrap 62, a fixed wrap 64, and their associated back plates 58, 60. The orbital movement of scroll 62, of course, as in typical scroll devices, is about an orbit axis "O" that intersects the base center of the orbiting scroll wrap 62 to produce a fluid transfer chamber or pocket between the wrap that moves radially between an inlet zone 70 and an outlet zone 71 in the compression mode when the orbiting wrap is moved relative to the fixed wrap about orbit radius $R_o$.

In accordance with this embodiment, the sprocket teeth are configured as circular pins 54, 56 extending axially from the fixed and orbiting back plates 58, 60 in interdigited or overlapping relationship.

As seen in FIG. 6, the synchronizer ring teeth elements comprise recesses and projections upon the inner periphery of the ring. The recesses 52 are likewise circular in configuration to match the external configuration of the pins 54, 56.

In all embodiments of the ring synchronizer, the spacing or pitch of the ring synchronizer teeth is selected to cooperate with the relative orbital movement between the scroll wraps and the scroll back plates.

In the embodiment of FIG. 5, the orbiting scroll back plate 60 may be driven by a motor 28 through a drive shaft 66 provided with an eccentric crank 68 which drives the orbiting back plate 60 about an orbit radius $R_o$. Upon actuation of motor 28 and rotation of drive shaft 66, orbiting scroll wraps 62 are driven relative to fixed scroll wraps 64 to cause fluid admitted through intake zone 70 to be radially transported to outlet 72 in accordance with known principles governing the operation of scroll fluid devices.

In accordance with an alternate embodiment as illustrated in FIG. 7, the synchronizer element is shown in the form of a flexible belt or hoop 74 that is substantially inextensible along its length yet free to flex transversely of its circumferential length. In this instance, the synchronizer 74 extends axially for a sufficient length to engage both back plates 76, 78 of a co-rotating scroll fluid device having an input drive shaft 80 driven by motor 82 and a fluid outlet 84 receiving compressed or transported fluid from intake zone 86. The same synchronizer 74 could just as well be utilized in a single orbiting scroll device wherein back plate 76 would be fixed against rotation and input shaft 80 would be provided with crank means to cause orbital motion of back plate 78 relative to back plate 76. In the embodiment of FIG. 7, the sprocket teeth extend around the periphery of the back plates and axially between the plates without overlap. The number of synchronizer and sprocket teeth may be selected to achieve the desired coupling between the synchronizer 74 and the back plate 76, 78.

Figure 8:
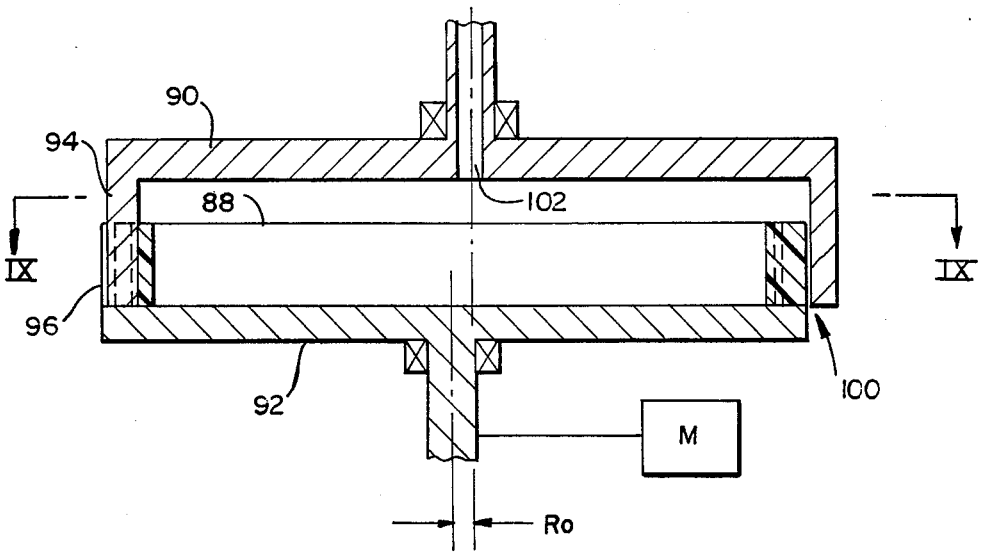
FIG. 8 shows a scroll device using a ring synchronizer with external teeth coupling elements.

Another alternate embodiment of the synchronizer is illustrated in FIGS. 8 and 9, wherein the synchronizer is in the form of a ring gear or hoop element 88 having external synchronizer teeth as illustrated best in FIG. 9. In this embodiment, co-rotating scroll wrap back plates 90 and 92 are provided with axially extending, interdigited sprocket teeth 94, 96 that engage ring synchronizer teeth 98 in cooperating, coupling relationship that, as seen in FIG. 9, secures the ring 88 within the annular rows of sprocket teeth 94, 96. In this embodiment, the fluid device is configured as a co-rotating compressor with back plates 90, 92 supporting scroll wraps (not illustrated) that transfer fluid from a radially outer zone 100 to a central area outlet 102.

The synchronizer ring element 88 with external teeth has the advantage that centrifugal forces keep the teeth 98 of the synchronizer clear of contamination that otherwise might gather in the recess between the projections forming the synchronizer teeth. In addition, centrifugal loads can be taken up in this embodiment by the sprocket teeth 94, 96 which generally will be made of metal or other rigid material while the synchronizer 88 can be made of a more yieldable material, for example a suitable plastic resin suitable for the purpose but not so flexible as to permit the ring to readily collapse inwardly to the extent that the synchronizer teeth become uncoupled from the sprocket teeth. The resin may be selected from appropriate plastic compounds, for example, a thermoplastic such as nylon, which will tend to creep radially outwardly under the centrifugal loading of operation of the co-rotating fluid device to compensate for wear in the external teeth area.

In all of the embodiments illustrated, it is assumed that the scroll wraps are based upon an involute generated from a base circle, although conceivably other involute configurations could be accommodated by the synchronizer of the present invention. Essentially, the sprocket teeth need to be spaced appropriately about the center of the base circle of each wrap to permit proper engagement between the sprocket teeth and the synchronizer teeth. The circumferential spacing between the sprocket teeth may be selected to accommodate the various loads transmitted through the synchronizer coupling and the configuration of the teeth themselves may take virtually any form that will result in transfer of forces and coupling between the scroll wraps that would otherwise tend to cause relative angular displacement between the wraps. The teeth could be configured in the shape of gear teeth, wedges, circular pins, etc. Moreover, the teeth could be fine of coarse, depending on expected loads and other design considerations. However, the coupling between the synchronizer and the scroll wraps will always permit minor axial excursions between the scroll wraps and the synchronizer itself without rigid constraints and the number of sprocket/synchronizer teeth can be selected to evenly distribute the wear on all the synchronizer teeth.

The synchronizer element may be formed of a single material possessing the appropriate characteristics of radial flexibility across its thickness and inextensibility along its circumferential length, or a composite material, for example metal/elastomer, and preferably the teeth are formed of a material that is relatively more yieldable than the sprocket teeth with which they are coupled. For example, the sprocket teeth could be formed of metal while the synchronizer teeth could be formed of an elastically yieldable plastic resin that permits good coupling between the teeth while still resisting relative angular deflection between the scroll back plates. The yieldable synchronizer teeth accommodate wear, run more quietly than unyielding teeth and do not require lubrication.

For a typical scroll device including a pair of scroll wraps spinning on parallel axes separated by an orbit radius, the spacing t between belt teeth centers can be calculated as follows:

$$t=R_o/(N_2-N_1)=2R_o/m \quad (1)$$

where:

$t$=teeth pitch
$R_o$=orbit radius
$N_2$=numbers of synchronizer ring teeth
$N_1$=number of sprocket teeth
$m=N_2-N_1$ The ring tooth pitch or spacing t is also related to the diametral pitch P as follows:

$$P=\pi/t \quad (2)$$

The sprocket diameter D may be calculated from its diametral pitch P and the number of teeth N as follows:

$$D=N/P \quad (3)$$

In general, m can be any small integer, either positive or negative in sign. When external sprockets are synchronized by an encircling synchronizer having $N_2$ teeth meshing with sprocket teeth of $N_1$, m is positive.

It is to be understood that various other physical embodiments of the invention can be formulated in accordance with principles that are well known to those skilled in the art without departing from the spirit and scope of the invention as defined in the claims that follow.

What is claimed is:

1. A scroll fluid device comprising:

at least one pair of meshed axially extending involute spiral wraps having base centers and defining at least one chamber between the wraps that moves radially between an inlet zone and an outlet zone when one wrap is orbited by translation along a curvilinear orbit radius about an orbit center relative to the other wrap;

wrap support means secured to and supporting each wrap;

means for mounting the wrap support means for relative orbital motion relative to each other;

synchronizer means for preventing relative rotation of one wrap relative to the other notwithstanding said relative orbital motion;

said synchronizer means including a plurality of sprocket teeth means affixed to each wrap support means, said sprocket teeth means spaced symmetrically about the center of a base circle of each wrap; and a flexible ring synchronizer element spanning said sprocket teeth means and including a plurality of ring teeth elements coupled at all times with at least one of the sprocket teeth of both the wrap support means, while uncoupled from the sprocket teeth means of one of the wrap support means at a first location located on a line diametrically extending through said orbit center, and including said base centers of said wraps, and uncoupled from the teeth means of the other wrap support means at a second location located on said line on the diametric opposite side of said orbit center from said first location;

whereby forces tending to cause rotation of one wrap support means relative to the other are reacted through the ring teeth elements and the sprocket teeth means and transmitted between the wrap support means while said ring synchronizer accommodates said relative orbital motion to thereby prevent relative rotation between the wraps.

2. A scroll fluid device as claimed in claim 1, wherein one of said wraps is fixed and said means for mounting the wrap support means includes means for enabling the other wrap to orbit relative to the fixed wrap about said orbit center.

3. A scroll fluid device as claimed in claim 1, wherein said means for mounting the wrap support means includes means for enabling both wraps to co-rotate about parallel axes separated by a distance corresponding to an orbit radius centered about said orbit center.

4. A scroll fluid device according to any one of claims 1, 2 or 3 wherein said ring synchronizer element comprises a hoop element with ring teeth elements spaced circumferentially around the inner periphery of the hoop element.

5. A scroll fluid device as claimed in any one of claims 1, or 3, wherein said ring synchronizer element comprises a hoop element with ring teeth elements spaced circumferentially around the outer periphery of the hoop element.

6. A scroll fluid device as claimed in claim 5, wherein said sprocket teeth means comprise pin elements each having a circular profile.

7. A scroll fluid device as claimed in claim 6, wherein said hoop element includes sprocket teeth engaging notches having circular profiles for receiving said sprocket teeth means, said notches disposed between the ring teeth elements.

8. A scroll fluid device as claimed in any one of claims 1, 2 or 3, wherein said wrap support means comprises circular back plates, said wraps being disposed between the back plates, and said sprocket teeth means being disposed along the outer periphery of the back plates.

9. A scroll fluid device as claimed in any one of claims 1, 2 or 3, wherein said wrap support means comprise back plates, said wraps being disposed between the back plates, and said sprocket teeth means extending axially towards each other between the back plates in interdigited relationship.

10. A scroll fluid device as claimed in any one of claims 1, 2 or 3, said synchronizing element comprising a belt member.

11. A scroll fluid device as claimed in claim 10, said belt member including integrally molded ring teeth elements.

12. A scroll fluid device as claimed in claim 1, said synchronizer element comprising a hoop element, with at least said ring teeth elements being formed from an elastically yieldable plastic resin.

13. A scroll fluid device as claimed in claim 5, wherein said synchronizer element comprises a hoop element and wherein said ring teeth elements are formed from unfilled molded thermoplastic resin.

14. A scroll fluid device as claimed in claim 1, wherein the number of ring teeth elements is greater than the number of sprocket teeth means, with the difference in the number being equal to or greater than unity.

* * * * *